US009587375B2

(12) United States Patent
Carbaugh et al.

(10) Patent No.: US 9,587,375 B2
(45) Date of Patent: Mar. 7, 2017

(54) BUCKET OF A ROPE SHOVEL

(71) Applicant: CNC Industries Ltd., Edmonton (CA)

(72) Inventors: Eric Carbaugh, Sundance, WY (US); Kristofer Henke, Edmonton (CA); Paramdeep Gill, Edmonton (CA)

(73) Assignee: CNC Industries Ltd., Edmonton (CA)

( * ) Notice: Subject to any disclaimer, the term of this patent is extended or adjusted under 35 U.S.C. 154(b) by 52 days.

(21) Appl. No.: 14/679,730

(22) Filed: Apr. 6, 2015

(65) Prior Publication Data

US 2016/0289920 A1 Oct. 6, 2016

(51) Int. Cl.

| | |
|---|---|
| ***E05D 5/10*** | (2006.01) |
| ***E02F 9/00*** | (2006.01) |
| ***E05D 5/12*** | (2006.01) |
| ***E05D 3/02*** | (2006.01) |
| ***E02F 5/02*** | (2006.01) |
| ***E02F 3/40*** | (2006.01) |

(52) U.S. Cl.

CPC ..... *E02F 9/006* (2013.01); *E02F 3/40* (2013.01); *E02F 5/025* (2013.01); *E05D 3/02* (2013.01); *E05D 5/125* (2013.01); *E05D 2005/102* (2013.01)

(58) Field of Classification Search

CPC ..... E02F 3/02; E02F 3/40; E02F 5/025; E02F 5/125; E02F 9/006; E05D 5/10; E05D 2005/102

USPC ..... 16/360, 386

See application file for complete search history.

(56) References Cited

U.S. PATENT DOCUMENTS 1,826,920 A * 10/1931 Brendlin ..... E02F 3/60 37/399
1,871,031 A * 8/1932 Bommer ..... E05D 3/02 16/386
2,510,896 A * 6/1950 Le Tourneau ..... E02F 9/006 384/583
2,967,726 A * 1/1961 Weston ..... E02F 9/006 403/157
3,904,299 A * 9/1975 Loonis ..... F16C 11/045 277/500
4,243,341 A * 1/1981 Kabay ..... F16C 11/02 403/158
4,279,085 A * 7/1981 Arnold ..... E02F 3/40 172/699
4,295,287 A * 10/1981 Natzke ..... E02F 3/3622 403/316
4,400,898 A * 8/1983 Christensen ..... E02F 9/006 37/444
4,561,154 A * 12/1985 Briscoe ..... F16G 11/046 24/115 M
4,607,977 A * 8/1986 Varnelis ..... F16C 11/045 29/525.03
4,961,667 A * 10/1990 Reinsma ..... E02F 9/006 403/11
5,577,858 A * 11/1996 Kasim ..... E02F 3/58 403/157

(Continued)

*Primary Examiner* — Roberta Delisle
(74) *Attorney, Agent, or Firm* — Seed IP Law Group LLP

(57) ABSTRACT

A retaining arm is attached to an end of a padlock pin forming a hinged connection between a padlock and a bucket of a rope shovel, the retaining arm extending perpendicularly to an axis of the padlock pin to connect to a connecting element on the bucket to restrain rotation of the padlock pin relative to the bucket.

5 Claims, 7 Drawing Sheets

(56) References Cited

U.S. PATENT DOCUMENTS

| | | | | |
|---|---|---|---|---|
| 6,273,632 | B1 * | 8/2001 | Takahashi | F16C 11/02 403/14 |
| 6,694,571 | B2 * | 2/2004 | Albright | E02F 9/006 16/380 |
| 7,043,858 | B2 * | 5/2006 | Martinez | E02F 9/006 37/443 |
| 7,296,369 | B2 * | 11/2007 | Martinez | E02F 9/006 16/223 |
| 7,651,274 | B2 * | 1/2010 | Yamamoto | E02F 9/006 384/203 |
| 7,770,311 | B2 * | 8/2010 | Hahnel | E02F 3/3609 37/403 |
| 8,944,717 | B2 * | 2/2015 | Ditzler | F16C 11/045 403/153 |
| 2009/0007384 | A1 * | 1/2009 | Lin | E05D 11/06 16/375 |
| 2009/0165252 | A1 * | 7/2009 | Chern | E05D 11/087 16/386 |

* cited by examiner

BUCKET OF A ROPE SHOVEL

TECHNICAL FIELD

Hinge elements, particularly for rope shovels for mining.

BACKGROUND

In rope shovels, a bucket is hingedly connected to a bucket handle and separately hingedly connected to a receiver for a hoist rope. These connections cooperate to move and support the bucket. The hinged connection between the bucket and the receiver for the hoist rope conventionally comprises a lug attached to the bucket, and an element referred to herein as a padlock which connects to the receiver for the hoist rope, the padlock having two lugs, one on each side of the lug of the bucket. A pin, referred to herein as a padlock pin, is inserted through the lugs to form a hinge. The pin may also be referred to as a bail pin and for the purposes of this disclosure and the claims these terms should be considered interchangeable and the use of a particular term should not be considered to be limiting. This hinge is exposed to a great deal of force during normal use of the rope shovel. Conventionally, to provide bearing surfaces for the pin, bushings are provided within the lugs. In the conventional design, the pin can rotate with respect to the bucket and the associated bushing (main lug bushing), causing wear due to the rotational friction of the pin with the bushing.

SUMMARY

There is provided a retainer for a padlock pin, the padlock pin being adapted to connect a padlock to a lug of a bucket of a rope shovel, the retainer having a pin attachment portion adapted to rigidly attach to the padlock pin, and an arm portion adapted to connect to a connecting element attached to the bucket to restrain rotation of the padlock pin relative to the bucket.

In various embodiments, there may be included any one or more of the following features: the retainer may be adapted to be attached to an end of the padlock pin, the retainer may be adapted to be welded to the padlock pin, the connecting element may be a pair of stops configured to restrain the padlock pin arm between the stops of the pair, and the arm portion may extend perpendicular to an axis defined by the padlock pin when the retainer is attached to the padlock pin.

There is provided a padlock pin adapted to connect a padlock to a lug of a bucket of a rope shovel, the padlock pin comprising a pin portion, and an arm portion rigidly attached to the pin portion, the arm portion adapted to connect to a connecting element attached to the bucket to restrain rotation of the padlock pin relative to the bucket. In various embodiments, there may be included any one or more of the following features: the arm portion may be attached to an end of the pin portion, the arm portion may be welded to the pin portion, the connecting element may be a pair of stops configured to restrain the arm portion between the stops of the pair, and the arm portion may extend perpendicular to an axis defined by the padlock pin.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

Figure 1:
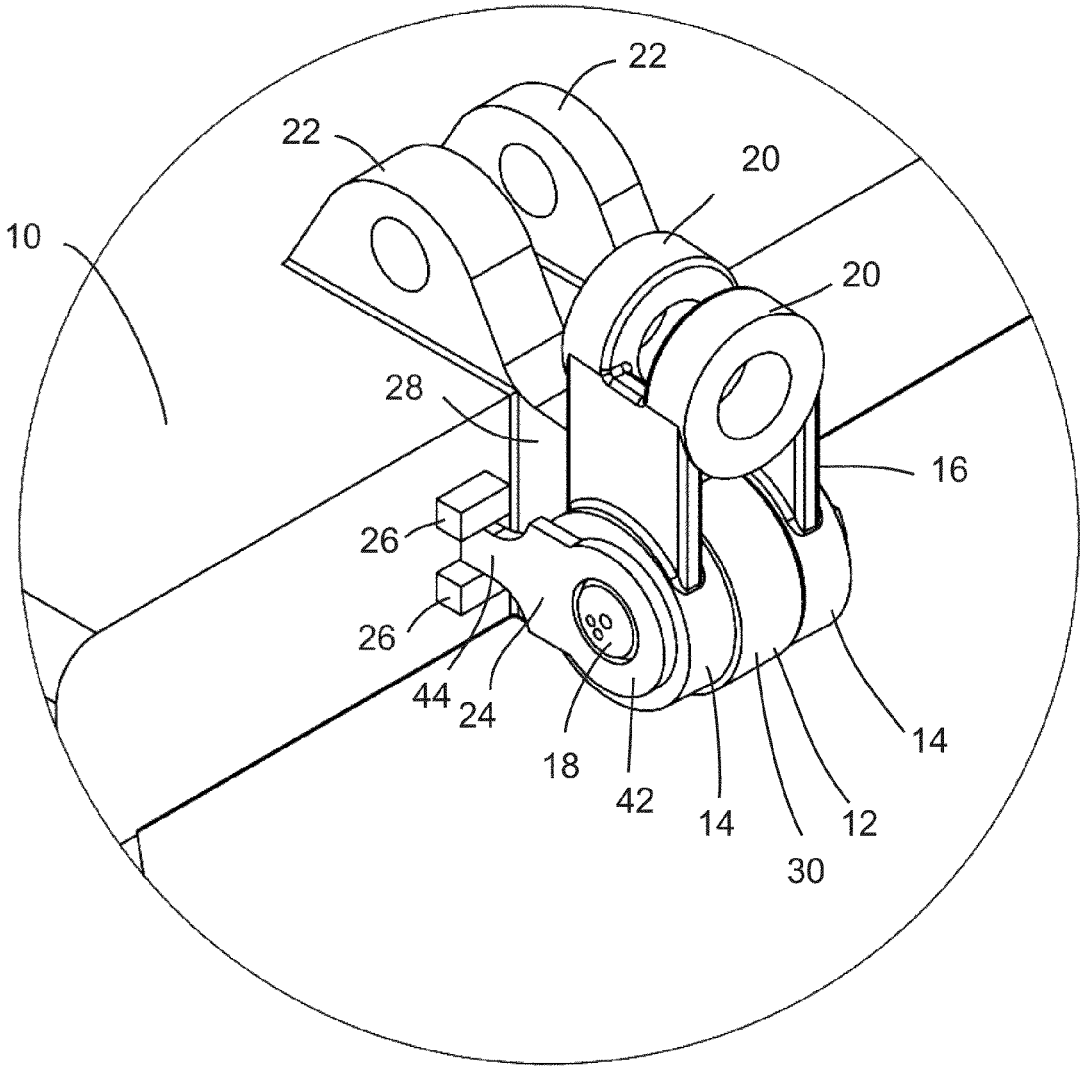
FIG. 1 is a perspective drawing of a padlock with a retainer according to an embodiment of the present invention shown in the context of a bucket of a rope shovel.
Figure 2:
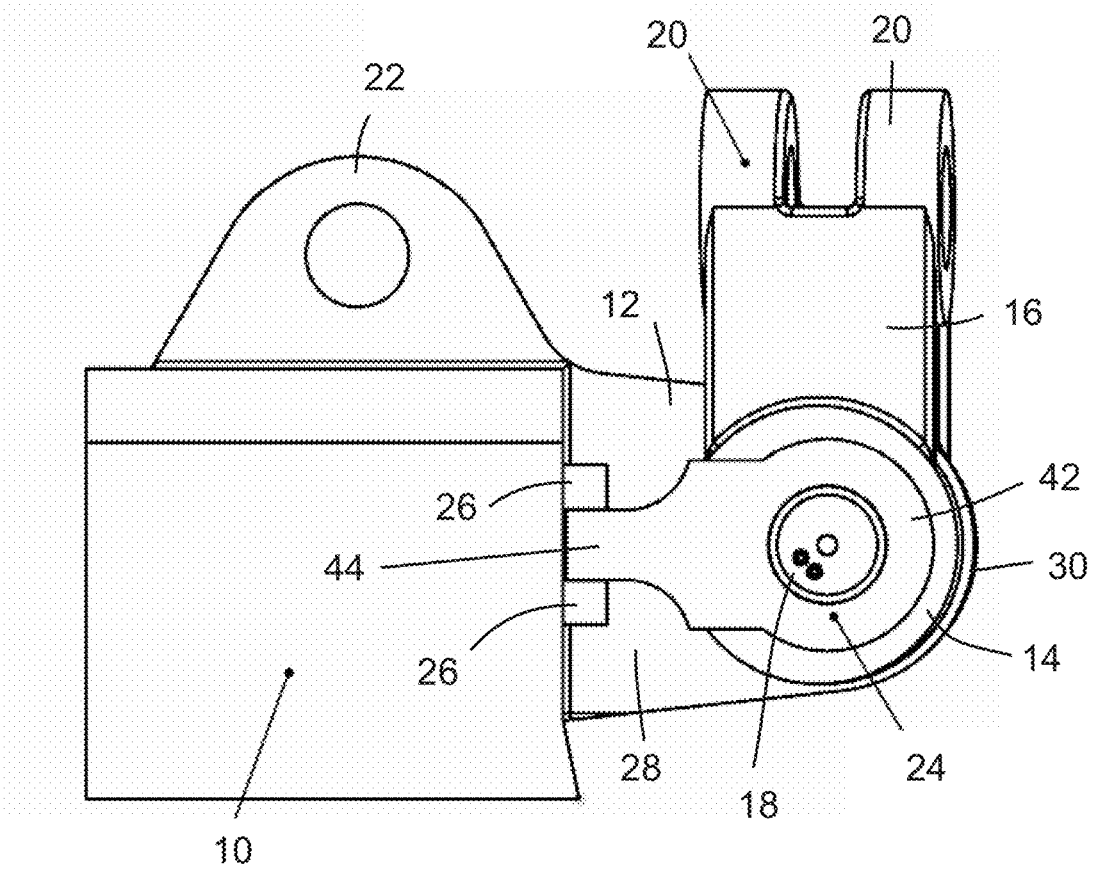
FIG. 2 is a side view of the padlock of FIG. 1 showing the retainer, and including a smaller portion of the bucket.

The embodiments shown here are shown in the context of the bucket of a Bucyrus™ 495 rope shovel, but the invention is not limited to any particular variety of rope shovel and could also be applied to hinges in contexts other than rope shovels. FIG. 1 is a perspective drawing of a padlock with a retainer according to an embodiment of the present invention shown in the context of a bucket of a rope shovel, and FIG. 2 is a side view of the padlock of FIG. 1. The circle around FIG. 1 merely indicates the limits of the view and is not an element or a boundary of any element. The conventional aspects of FIG. 1 and FIG. 2 will be described first. As shown in FIG. 1 and FIG. 2, a bucket 10 of a rope shovel has a lug 12 for forming a hinged connection to lugs 14 of padlock 16. Padlock pin 18 is inserted through lugs 12 and 14 to form the hinged connection. The padlock has lugs 20 to form a hinged connection with a receiver for a hoist rope (not shown). Bucket 10 also has lugs 22 to form a hinged connection with a bucket handle (not shown).

The novel aspects of FIG. 1 and FIG. 2 will now be described. A retainer arm 24 is attached to an end of padlock pin 18 and connects to a connecting element 26 on the bucket 10. The retainer arm 24 in this embodiment generally comprises a flange 42 for encircling and attaching to the pin 18 and an arm portion 44 for connecting to the connecting element 26. In this embodiment, the flange 42 and arm portion 44 are together made of a single unitary piece of material. If the pin extends some distance beyond the lugs, then any position on the pin beyond the lugs is considered to be the "end" of the pin. It is also possible that a padlock might be configured to have a space between a padlock lug and a bucket lug to receive a retainer arm of the padlock pin. In that case, the retainer arm could extend between the lugs and would, in this case, not be at the end of the padlock pin. The retainer arm would preferably be removably attached in that case to enable the pin to be removed.

The retainer arm restrains rotation of the padlock pin relative to the bucket. In this embodiment, the connecting element is a pair of stops that restrains the retainer arm between the stops. The stops in this embodiment are formed of 3 in×3 in square stock welded to the bucket 10. Other connecting elements could be used. Preferably, the connecting element allows some degree of motion of the retainer arm in directions other than rotation around the axis of the pin. Preferably, the retainer arm is rigidly attached to the padlock pin, for example permanently attached by welding.

Preferably, the retainer arm extends perpendicularly to the axis of the padlock pin, so that it is subject to only bending and not twisting forces and doesn't apply forces to the padlock pin that are outside the plane perpendicular to the axis of the padlock pin. In a less preferred embodiment, a retainer arm bent away from a direction perpendicular to the axis of the padlock pin could be used, for example to connect to a connecting element on the lug of the bucket, either on the side 28 of the lug or end 30 of the lug.

Figure 3:
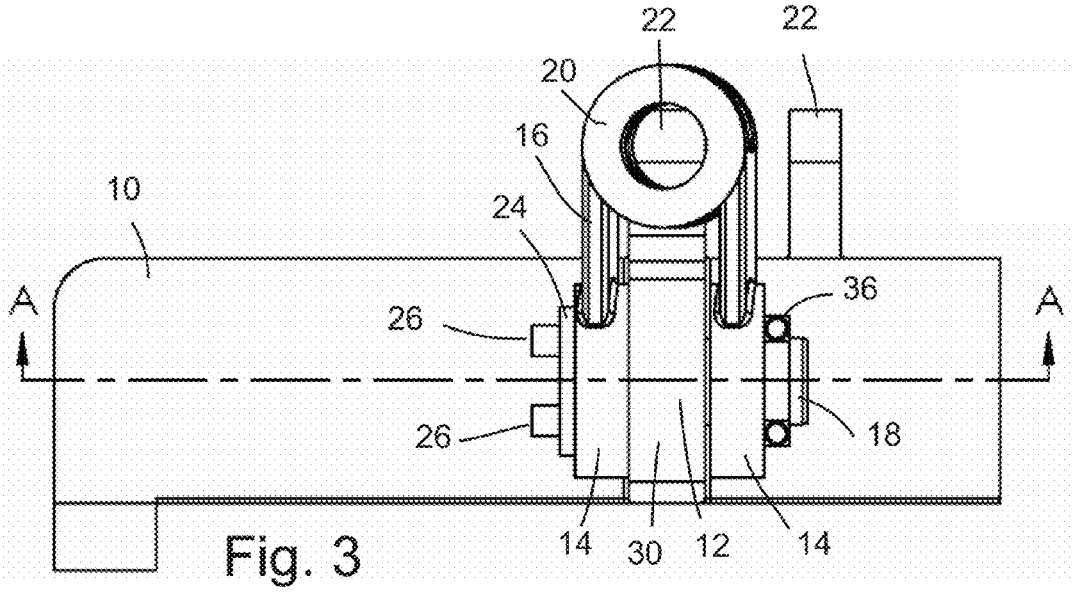
FIG. 3 is a top view of the padlock of FIG. 1, where top is the direction shown to the right in FIG. 2 and lower right in FIG. 1, shown in context of a portion of the bucket.
Figure 3A:
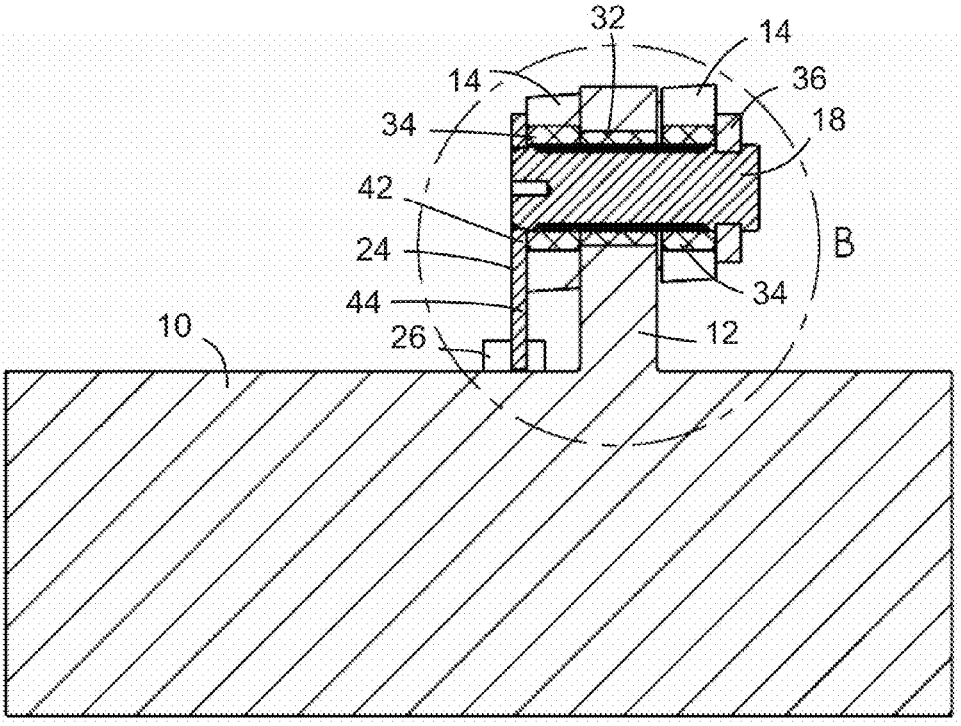
FIG. 3A is a front section view showing the section indicated by line A-A in FIG. 3, showing interior details of the padlock.
Figure 3B:
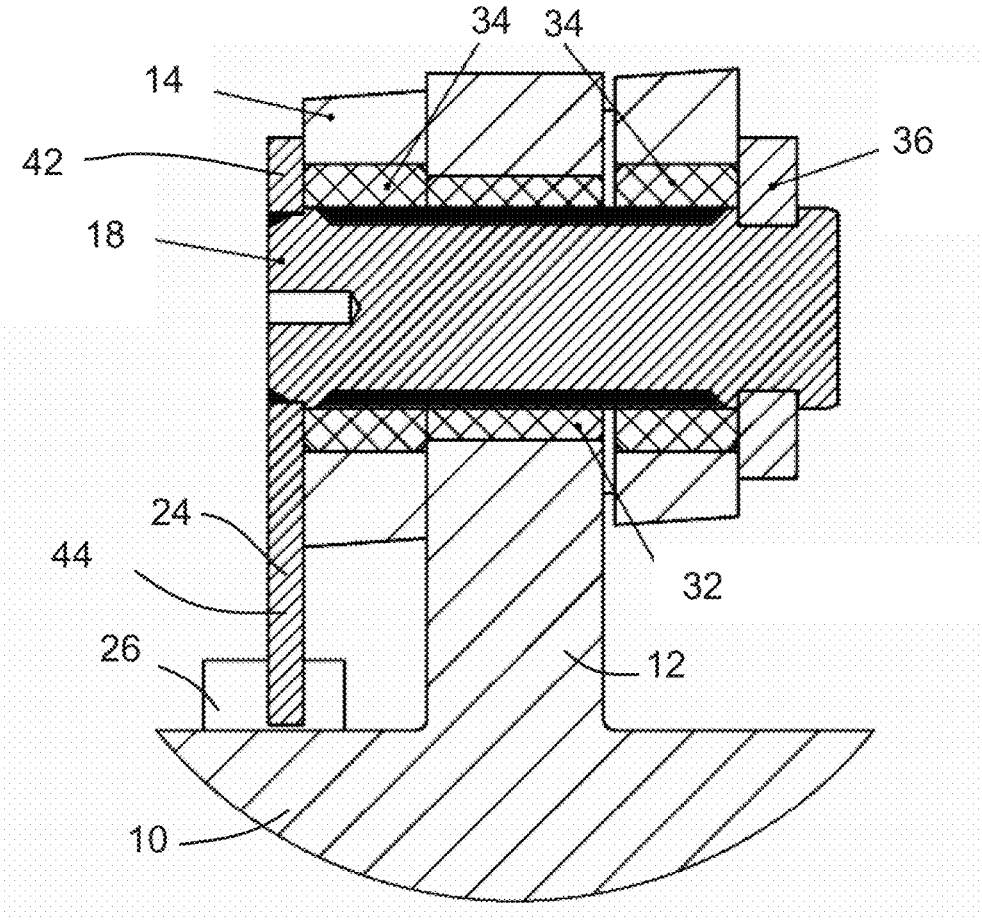
FIG. 3B is a close up of the section of the padlock, showing the area indicated by circle B in FIG. 3A.

FIG. 3 shows the padlock of FIG. 1 and FIG. 2 as viewed from the right side of FIG. 2. A collar assembly 36 secures an end of the pin 18, in this embodiment opposite to the retainer arm 24, from sliding through the lugs. Section line A-A indicates the section shown by FIG. 3A. Circle B in FIG. 3A indicates the area shown in close up in FIG. 3B. As shown in FIG. 3A and FIG. 3B, lugs 12 and 14 respectively contain bushings 32 and 34. The bushings provide bearing surfaces for the padlock pin 18. The retainer for the padlock pin, by restraining rotation of the pin relative to the bucket, prevents the pin from spinning on bushing 32, forcing the bushings 34 to deal with rotational friction relative to the padlock pin instead of bushing 32.

Figure 4:
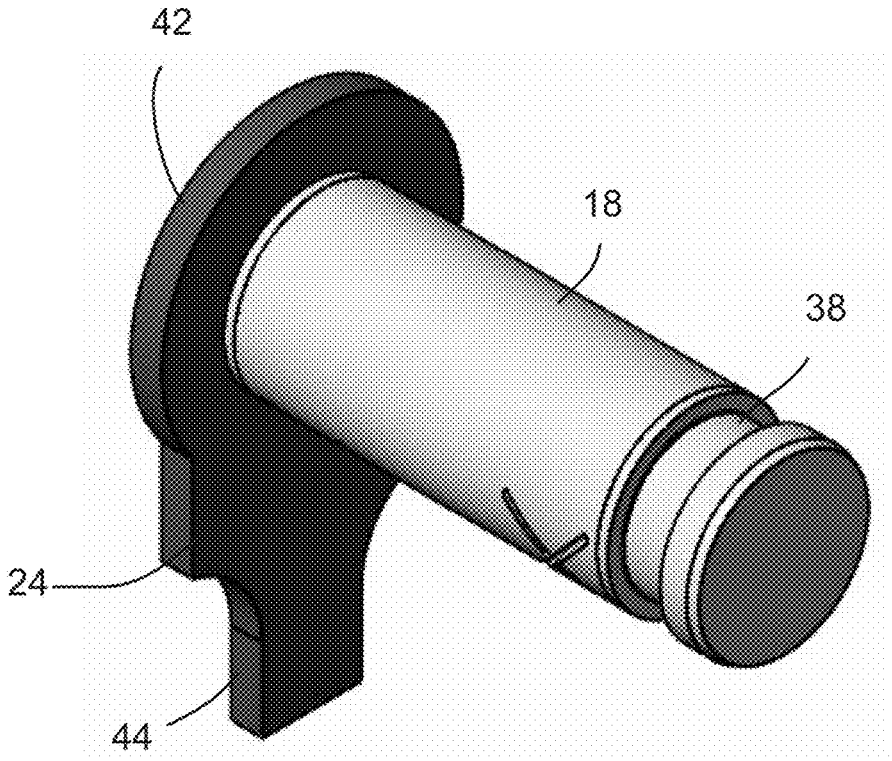
FIG. 4 is a perspective view of the padlock pin and retainer arm of FIG. 1.

FIG. 4 is a perspective view of the padlock pin and retainer arm of FIG. 1. As can be seen in FIG. 4, padlock pin 18 in this embodiment is generally cylindrically shaped defining an axis. At one end of the pin, retainer arm 24 extends perpendicularly from the axis, and another end defines a groove 38 to receive collar assembly 36.

Figure 5:
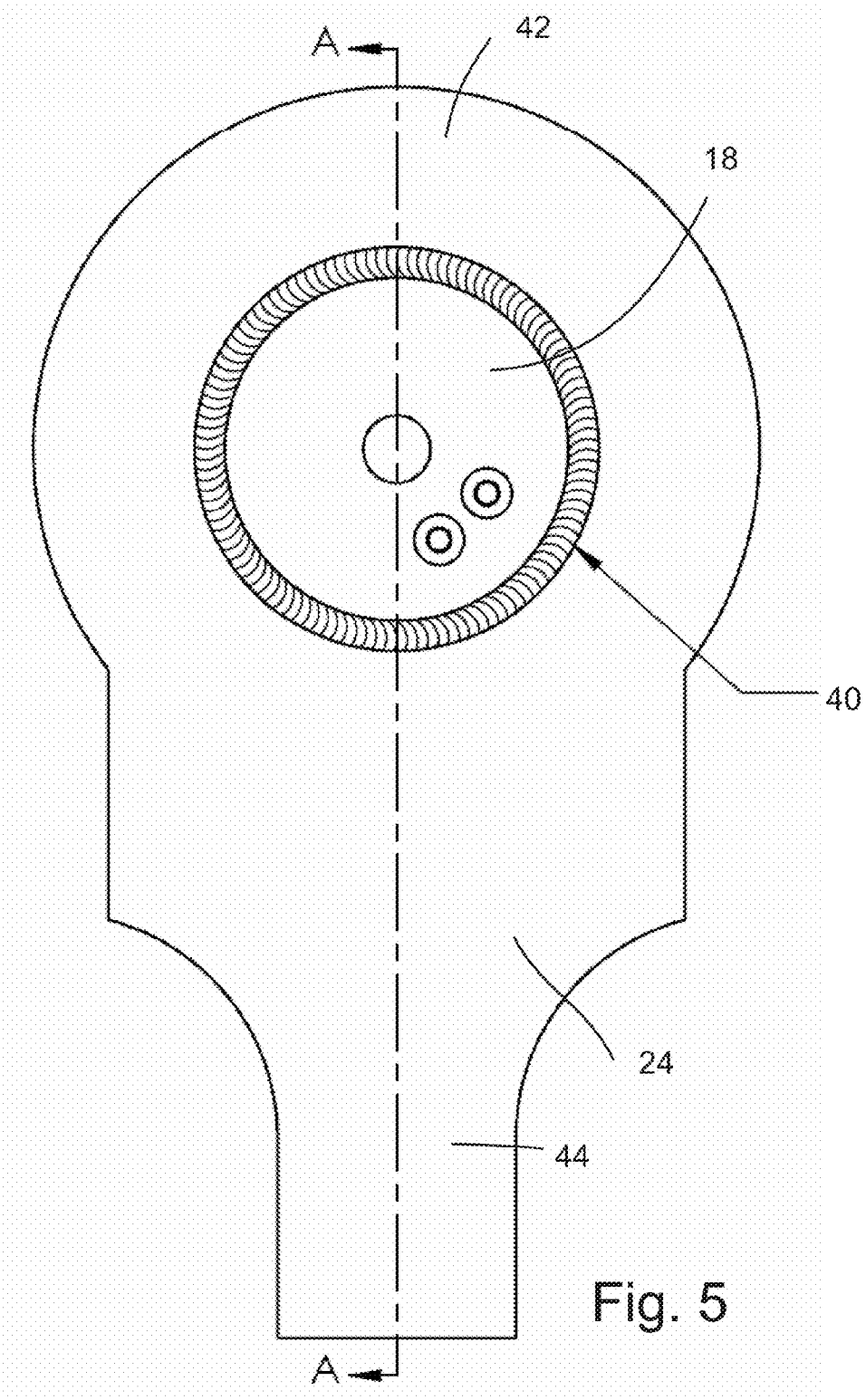
FIG. 5 is an end view of the padlock pin and retainer arm of FIG. 4.
Figure 5A:
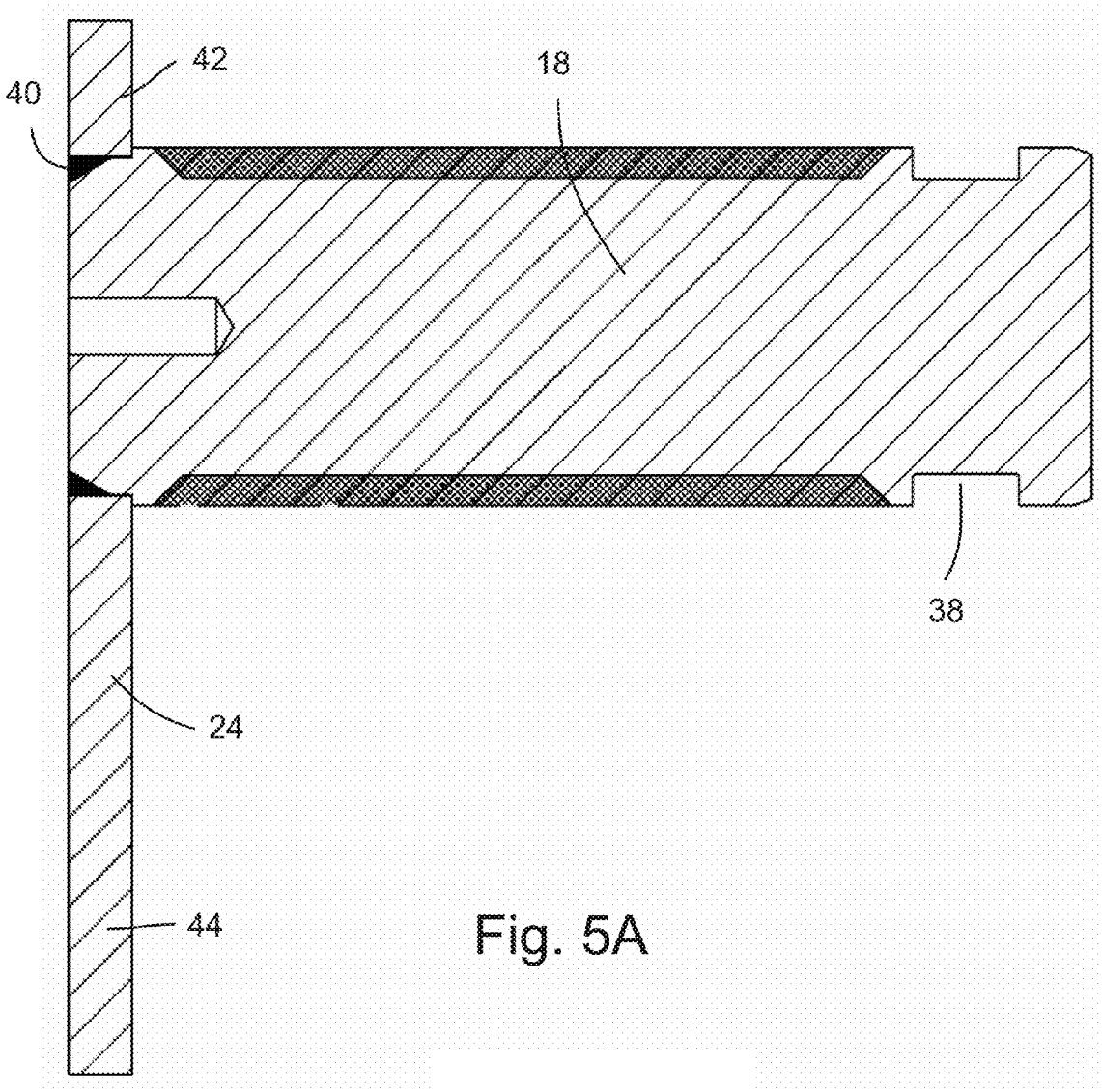
FIG. 5A is a section view of the padlock pin and retainer arm showing the section A-A in FIG. 5.

FIG. 5 shows an end view of the padlock pin and retainer arm of FIG. 4. In the embodiment shown, weld 40 affixes retainer arm 24 to pin 18. FIG. 5A is a section view of the padlock pin and retainer arm showing the section A-A from FIG. 5.

Immaterial modifications may be made to the embodiments described here without departing from what is covered by the claims.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A bucket of a rope shovel, the bucket comprising:

a bucket lug;

a padlock having padlock lugs, the bucket lug forming a hinged connection with the padlock lugs and the bucket lug being between the padlock lugs;

a padlock pin, the padlock pin being received by the padlock lugs and the bucket lug, in which the retainer includes:

a pin attachment portion rigidly attached to the padlock pin; and an arm portion connected to a connecting element attached to the bucket to restrain rotation of the padlock pin relative to the bucket lug.

2. The bucket of claim 1 in which the retainer is attached to an end of the padlock pin.

3. The bucket of claim 2 in which the retainer is welded to the padlock pin.

4. The bucket of claim 1 in which the connecting element comprises a pair of stops configured to restrain the arm portion between the stops of the pair.

5. The bucket of claim 1 in which the arm portion extends perpendicular to an axis defined by the padlock pin.

* * * * *